US005829221A

United States Patent [19]

Archuleta

[11] Patent Number: 5,829,221

[45] Date of Patent: Nov. 3, 1998

[54] ROOFING TOOL

[76] Inventor: Rick A. Archuleta, 5967 S. Gallup St., #109, Littleton, Colo. 80120

[21] Appl. No.: 814,592

[22] Filed: Mar. 10, 1997

[51] Int. Cl.[6] ..... E04D 15/00

[52] U.S. Cl. ..... 52/749.12; 294/49

[58] Field of Search ..... 52/749.12; 294/49, 294/55; 172/371, 374

[56] References Cited

U.S. PATENT DOCUMENTS

| | | | |
|---|---|---|---|
| 887,009 | 5/1908 | Musgrove, Jr. | 294/49 X |
| 3,848,915 | 11/1974 | Wherry | 294/49 |
| 4,718,708 | 1/1988 | Zacuto | 294/49 X |
| 4,848,818 | 7/1989 | Smith | 294/55 X |

*Primary Examiner*—Creighton Smith
*Attorney, Agent, or Firm*—Lee, Fishman & Isaac; John L. Isaac

[57] ABSTRACT

A roofing tool is disclosed and includes an elongated handle having top and bottom end portions. A head member is provided and includes a flange portion secured to the bottom end portion of the handle and has a base edge and first and second side surfaces. The head member also includes a foot portion extending outwardly from the base edge of the flange portion away from the flange first side surface, the foot portion having top and bottom surfaces, a front edge, a side edge distal from the flange first side surface, and a rear edge. The rear and side edges of the foot portion are tapered while the front side edge of the foot portion is at least blunted. Finally, the flange portion is aligned with the handle so that the plane defined by the bottom surface of the foot portion is at approximately a 30°–60° angle relative to the axis of the elongated handle.

20 Claims, 4 Drawing Sheets

ROOFING TOOL

BACKGROUND OF THE INVENTION

1. Field of the Invention

The present invention relates generally to industrial implements and, more particularly, to tools for the roofing industry. Specifically, the present invention relates to a tool useful in the application of roofing material.

2. Description of the Prior Art

Residential and commercial building structures commonly utilize asphalt coverings on the roofs thereof. In residential structures, the asphalt material is commonly in the form of shingles of various types which are generally applied with nails or the like. Such asphalt shingles are typically applied over tar-paper, and the tools utilized by a roofer in such residential applications generally include various tools utilized in the carpentry industry as a whole, such as hammers, crow bars and the like. Trowels, such as those used in applying and smoothing plaster or concrete, may also be used by roofers to lift or manipulate the asphalt shingles as needed.

Commercial building structures, however, generally may require a different type of roofing application. In sloped roof structures, asphalt shingles may also be utilized similar to that for residential structures. However, many commercial buildings have flat roofs for which over-lapping asphalt shingles are inapplicable. In these flat-roofed structures, a roofer commonly applies rolled roofing in large single sheets. These rolls are frequently 100 square feet and come in rolls of three feet wide and about 33–34 feet in length. The common technique for applying such rolled roofing is to apply heated tar to the roof surface and then to roll the roofing material over this tar. Makeshift tools are commonly used for the application of the tar to the roof, and trowels are sometimes used along the edges of the rolled roofing material to ensure that tar is adequately applied along the edges of the roll as it is unrolled. This technique of applying rolled roofing material is extremely time consuming, messy and dangerous due to the hot tar application, and strenuous on the roofer inasmuch as the roofer frequently must remain on his knees to unroll the roofing material and trowel out the edges.

A recent innovation in the rolled roofing technology is in the form of roofing material in single rolls which are preimpregnated with the tar. This type of roofing material eliminates the necessity of hot tar buckets and the messy application of tar to the roof surface prior to rolling the roofing material. In such instances, the roofer utilizes a torch in one hand for softening the preimpregnated tar along the front edge of the rolled roofing material as it is unrolled. Thus, the roll of roofing material is slowly unrolled as the torch heats the tar to a soft, tacky consistency. As the roll is gradually unrolled, the roofer smoothes the material on the roof in order to ensure that the entire under surface of the material is pressed to the roof. Moreover, the roofer must ensure that the tar oozes out slightly along the side edges of the roll as it is unrolled in order to ensure a secure application and pass inspection.

To accomplish these maneuvers, a roofer frequently will be bending over pushing the roll of roofing material with one hand while heating the roll with a torch in the other hand. This torch is operating at approximately 2,0000° F., thereby placing the roofer very close to this heat source. Thus, previous techniques of applying this preimpregnated rolled roofing material is hard on the roofer due to the roofer bending over as well as unsafe due to the close proximity to the torch heat. The roofer frequently will use a hand trowel to press the side edges of the roofing material as it is unrolled. Moreover, the trowel can be used to lift the side edges of the material and heat them in order to ensure to that the tar along the edges has been sufficiently tackified to adhere the material to the roof surface.

As can be seen from the above, to date there are no tools specifically designed for application of roofing material. Instead, roofers have had to rely on tools designed for other purposes, such as trowels generally utilized in the smoothing of concrete and plaster. Examples of different types of garden tools which have aspects potentially useful in applying roofing material includes the following U.S. Pat. No. 88,659, No. 406,737, No. 780,453, No. 907,333, No. 1,185,581, No. 2,969,120, No. 3,240,277 and Design No. 181,828. As can be seen, however, the tools illustrated in the listed patents are designed for use as garden hoes and the like and are truly not applicable to the application of roofing material.

Thus, there remains a need in the roofing industry for a tool that is capable of meeting all of the needs of a roofer for applying preimpregnated rolled roofing yet will allow the roofer to remain standing and at a distance from the heat source of the torch.

SUMMARY OF THE INVENTION

Therefore, it is one object of the present invention to provide an improved roofing application tool.

It is another object of the present invention to provide a roofing tool which will enable a roofer to remain standing while applying preimpregnated rolled roofing.

Still another object of the present invention is to provide an improved roofing tool which will enable a roofer to remain at a safe distance from the heat source of a torch utilized in the application of preimpregnated rolled roofing.

Yet another object of the present invention is to provide an improved roofing tool for use with rolled roofing that will enable a roofer to, while in a standing position, unroll the roofing, smooth the roofing material as it is being unrolled, and lift edges of the roofing material for heating to ensure proper tackification of the preimpregnated material.

To achieve the foregoing and other objects and in accordance with the purpose of the present invention, as embodied and broadly described herein, a roofing tool is disclosed and includes an elongated handle having top and bottom end portions. A head member is provided and includes a flange portion secured to the bottom end portion of the elongated handle and has a base edge and first and second side surfaces. The head member also includes a foot portion extending outwardly from the base edge of the flange portion away from the flange first side surface, the foot portion having top and bottom surfaces, a front edge, a side edge distal from the flange first side surface, and a rear edge. The rear and side edges of the foot portion are tapered while the front side edge of the foot portion is at least blunted. Finally, the flange portion is aligned with the handle so that the plane defined by the bottom surface of the foot portion is at approximately a 30°–60° angle relative to the axis of the elongated handle.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Figure 3:
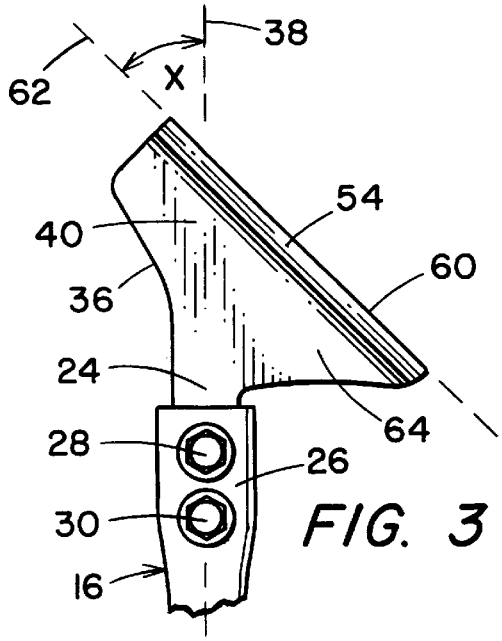
FIG. 3 is an enlarged front side view of the head portion of the device illustrated in FIG. 2.

Referring first to FIGS. 1–5, a roofing tool 10 includes an elongated handle 12 having an upper end portion 14 with a rubber cap 15 and a bottom end portion 16. The handle 12 is preferably approximately 6 feet in length and is constructed from lightweight aluminum. However, it should be understood that both the handle 12 and the remaining components of the device 10 may be constructed from any desired material such as aluminum, steel, wood and the like. Preferably, however, the material of choice is both lightweight, weather resistant and flame retardant. While the optimum length of the handle 12 is approximately 6 feet, this length is predicated on the preferred manner of use of the device 10 wherein the upper portion 14 is tucked underneath the arm pit of a user with the user grasping the midportion of the handle 12. Depending on the size of a user, the length of the handle 12 may be varied.

In preferred form, the midportion of the handle 12 includes a grip member 18 which is wrapped about the midportion of the handle 12. The grip member 18 may be preferably constructed from a rubber or a vinyl compound that has a coarse surface to enhance firm gripping of the device 10. A reinforcing member 20 is wrapped around the midportion of the handle 12 underneath the grip 18 to further enhance the gripping surface to enable one armed control of the device 10 during its use as discussed in greater detail below.

A head member 22 is secure to the bottom end portion 16 of the handle 12. The head member 22 is the primary operational portion of the device 10. In preferred form, the head member 22 includes a connecting shank 24 which is designed to be removably secured to the bottom end portion 16. In preferred form, the handle 12 is tubular in form, and the bottom end portion 16 includes a ferrule 26 which is sized and shaped to receive the shank 24. A pair of bolts 28, 30 pass through the ferrule 26 and the shank 24 and are secured by nuts 32, 34. In an alternate embodiment (not illustrated), the bolts 28, 30 can be press-fit against the surface of the shank 24 rather than passing through apertures in the shank 24.

Figure 4:
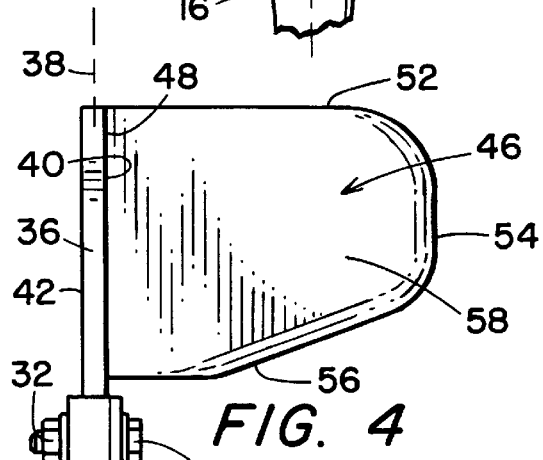
FIG. 4 is a top plan view of the head portion illustrated in FIG. 3.
Figure 5:
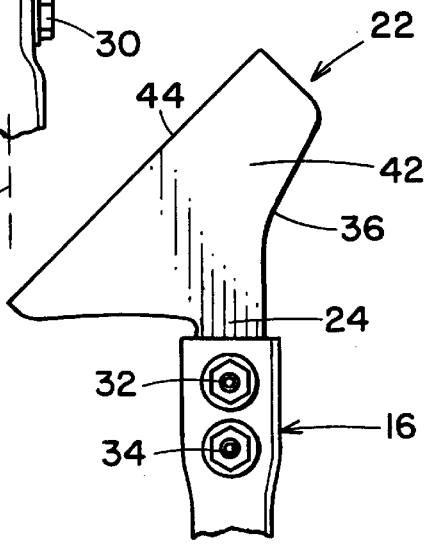
FIG. 5 is a rear side elevation view of the head portion illustrated in FIG. 3.
Figure 1:
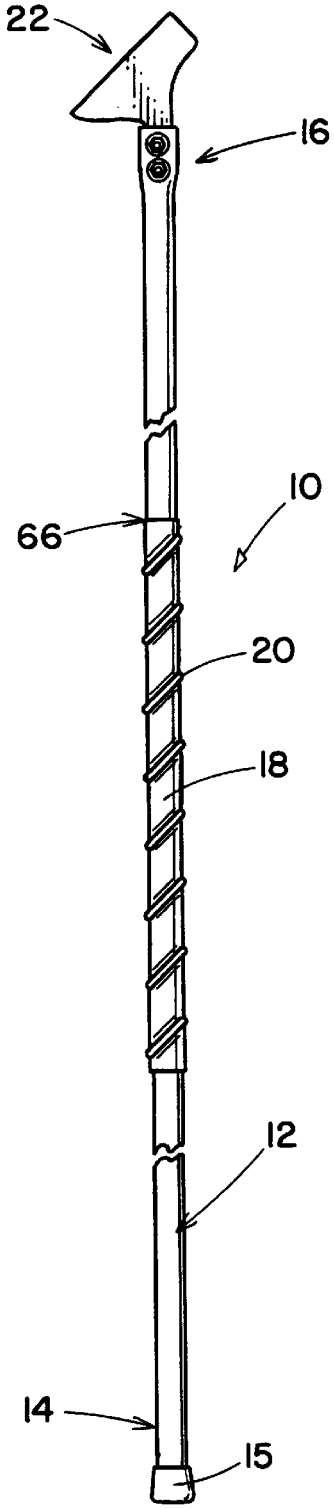
FIG. 1 is a side elevation view of the rear side of a roofing tool constructed in accordance with the present invention.
Figure 2:
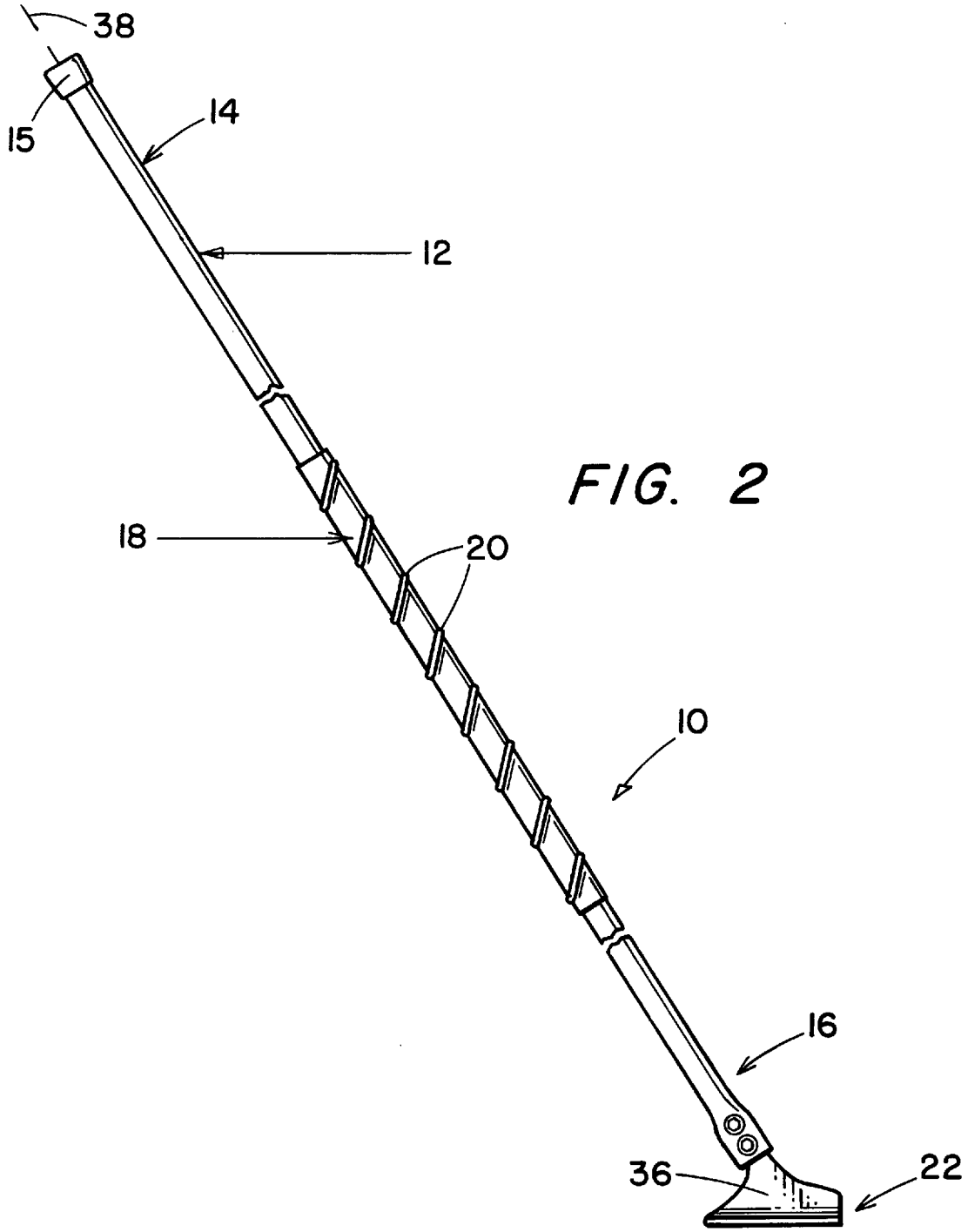
FIG. 2 is a side elevation view of the front side of the device illustrated in FIG. 1 and illustrating the device in operational position.
Figure 7:
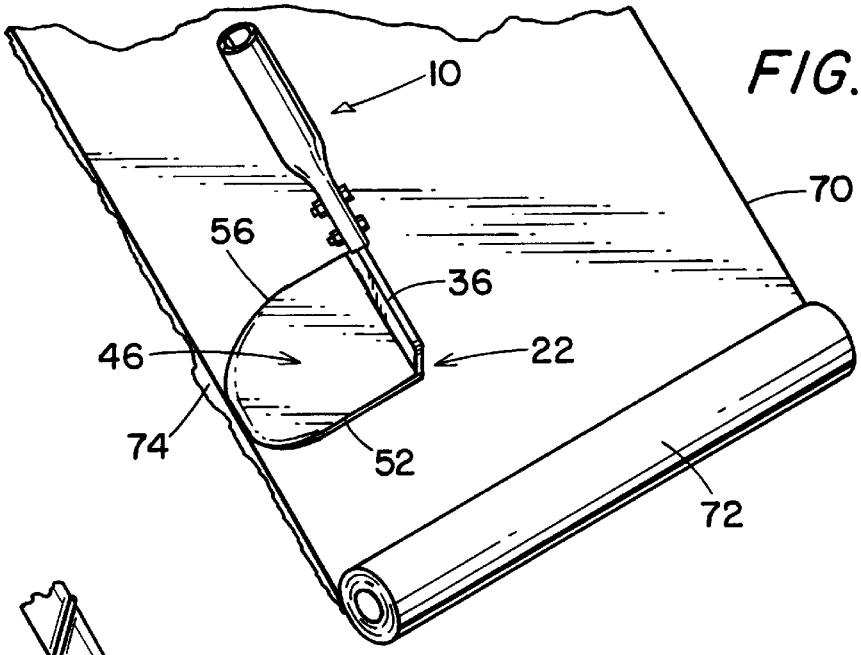
FIG. 7 is a top perspective view of the head portion of the present invention in position on roofing material illustrating the smoothing of the side edges thereof.
Figure 8:
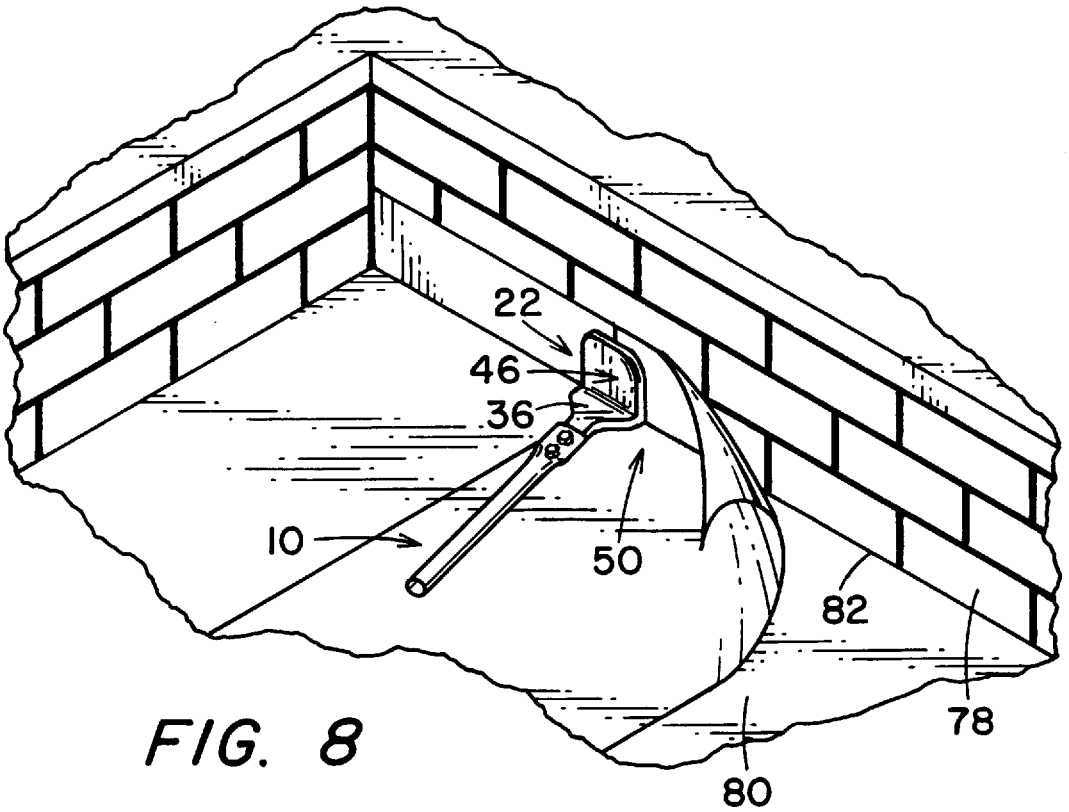
FIG. 8 is a perspective view of the tool of the present invention in position to smooth the end portion of a roll of roofing material against the side of a fire wall.

In preferred form, the head member 22 also includes a flange portion 36 that is substantially flat and lies in the same plane as the shank 24 and the central axis 38 of the handle 12. The flange 36 has a front side surface 40 and a back side surface 42 which terminate in a bottom edge 44. A foot portion 46 extends laterally outwardly from the flange 36 away from the front side surface 40 and includes an interior edge 48 which is secured to the bottom edge 44 of the flange 36 at substantially right angles as illustrated in FIGS. 4 and 8. This arrangement forms a squared cornered abutment 50 which is readily illustrated in FIG. 8 and described below.

The foot portion 46 is preferably in the form of a substantially flat member having a front edge 52, a side edge 54 and rear edge 56. The foot portion 46 may be shaped in any desired manner and may be, for example, in the form of a square, an arcuate member, and the like. In preferred form, the side edge 54 and rear edge 56 are tapered while the forward edge 52 may either be blunted or may also be tapered similar to edges 54 and 56. The taper of the edges 54 and 56 are particularly useful for lifting roofing material as described in greater detail below. In preferred form the edges 54 and 56, and when appropriate the edge 52, are tapered downwardly from the top surface 58 of the foot portion 46. The bottom surface 60 is preferably flat and lies in a plane indicated by the line 62. In preferred form, the plane 62 of the bottom surface 60 is substantially normal to the plane defined by the rear surface 42 of the flange 36. Moreover, in preferred form the plane 62 forms an angle "X" with the central axis 38 of the shank 24 and handle 12, and this angle "X" is preferably 30°–60°. In most preferred form, the angle "X" is approximately 45° so as to give an optimal angle of attack for using the device 10.

In preferred, the head member 22 also includes a bight portion 64 between the front surface 40 of the flange 36 and top surface 58 of the foot portion 46. This is in contrast to the right angle formed between the rear surface 42 of the flange 36 and the bottom surface 60 of the foot portion 46.

As can be seen from FIGS. 1–5, the shank 24, the flange 36 and the foot portion 46 are preferably all one integral unit. In the preferred embodiment, the shank 24 is removably attached to the end portion 16 as described above. However, it should be understood that the shank 24 may be integral with the end portion 16 so that the handle 12 and head member 22 comprise one integral unit. Moreover, the shank 24 may also simply be an attachment portion for the flange 36 rather than a separate identifiable shank portion of the head member 22.

As discussed above, a roofing tool 10 is particularly adaptable for use by a roofer in applying preimpregnated rolled roofing to the roof surface of a building. Since the roofer needs to hold a torch to soften the preimpregnated tar on the bottom side of the roofing material as it is unrolled, the present invention allows the roofer to work further away from the 2,000° torch flame inasmuch as the flame radiates extreme heat for approximately 6–12 inches. The device 10 of the present invention is designed to be held in the opposite hand from which the torch is held. The tool illustrated in the FIGS. 1–5 is designed for a right-handed person, i.e. the device 10 would be held in the left hand while the torch is held in the right hand. The rubber knob 15 on the top end portion 14 on the handle 12 permits the tool 10 to be picked up more readily with heavy leather gloves generally utilized by a roofer.

The upper portion 14 of the device 10 is generally positioned in the arm pit of a user in order to enable the roofer to push the weight of the heavy roll with his whole body instead of just using his arm strength, the length of the tool 10 providing significant leverage. In preferred form, the balance point of the tool 10 is at the lowermost portion 66 of the grip 18. In this manner, a roofer grabs the handle 12 along the grip 18 above the balance point 66, and with the upper portion 14 positioned in the arm pit, the roofer is able to maintain a perfect balance of the device 10 during use thereof. The long grip 18 allows the roofer to reach out in front of him to flip the sheet of material back or to push the rolled roofing forward. The length of the tool allows a roofer to stand up as opposed to bending over all day with a hand trowels pressing seams, lifting edges, troweling edges and the like as discussed below.

Figure 6:
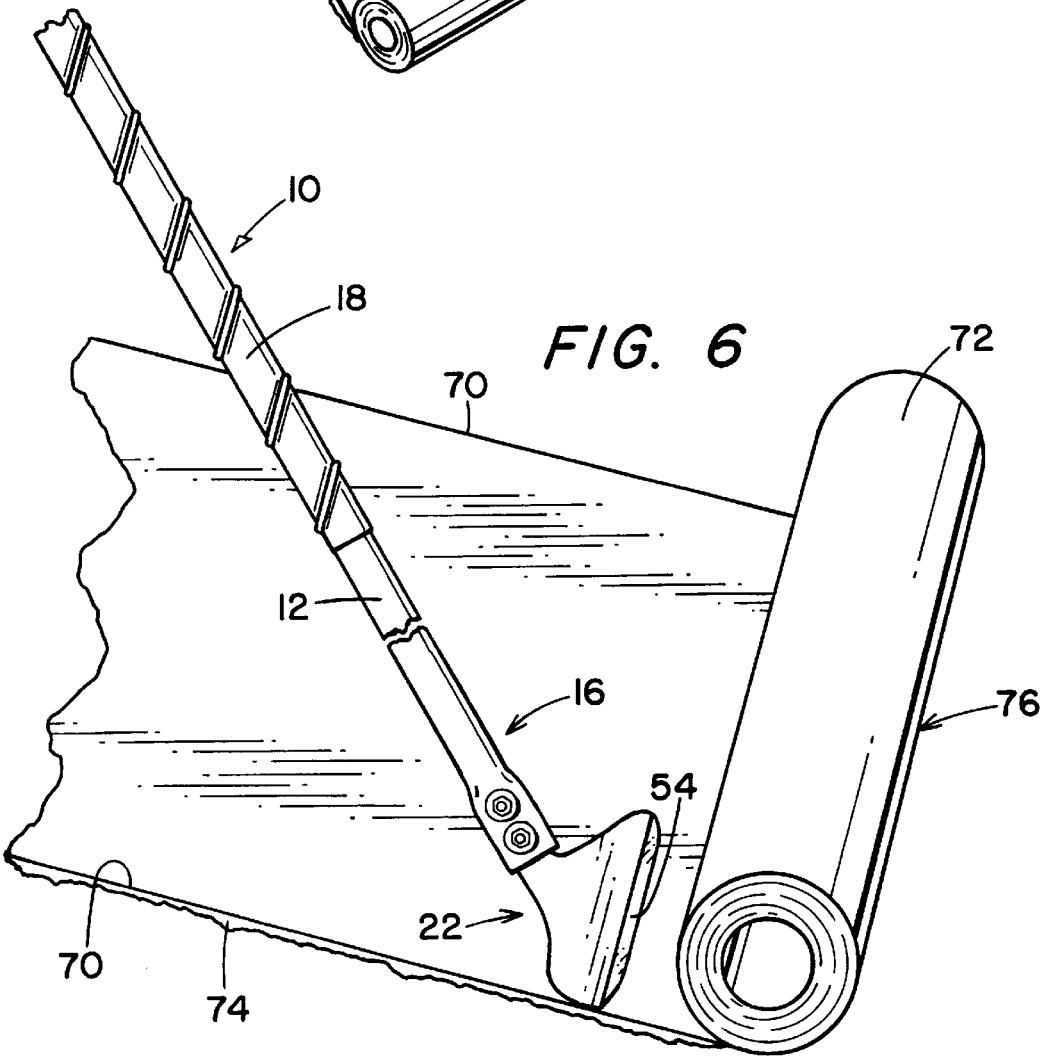
FIG. 6 is a top perspective view of the device construct in accordance with the present invention in position for unrolling roofing material.

Referring now to FIGS. 6–9, the foot portion 46 preferably is designed so that there are no sharp edges that will cut into the roofing material. The tapered edges 54, 56 of the foot portion 46 are provided for the ease of picking up the edges 70 of rolled roofing material 72. In this maimer, the edges 70 may be lifted and then heated. Once they are heated, they may be then redeposited onto the roof surface. The planer bottom surface 60 is designed so that, as in FIG. 7, the foot portion 46 may be used to smooth out the sides of the rolled roofing material so that the tar 74 is oozed out to ensure a tight seal. Without such a tight seal, water or snow can work its way under the roofing material 72 at the seams generated by the edges 70. In one mode of operation, the device 10 may be oriented so that the side edge 54 is pointed up, as illustrated in FIG. 6, so that the bottom surface 60 will be used to push the rolled roofing 72. It should be understood that the forward surface 76 of the rolled roofing 72 is the surface that is heated by a torch as the material 72 is unrolled by pushing it with the device 10. As the material 72 is unrolled, the sides 70 are smoothed with the device 10 and, if necessary, lifted up for reheating and then resmoothing as discussed above.

When the rolled roofing material 72 comes to its end along a wall 78, it is generally run up the wall 78 as illustrated in FIG. 8. Generally, coved cant strips make up the lower portion of the wall 78. The device 10 of the present invention provides significant assistance in accomplishing this by providing an abutment portion 50. The right angle of the abutment 50 enables the device 10 to smooth the material both on the roof surface 80 as well as smooth it along the wall 78 simultaneously at the comer 82 between the roof 80 and the wall 78. By running the device 10 along the edge 82, the roofing material 72 may be firmly sealed against the wall 78 without any gaps.

Figure 9:
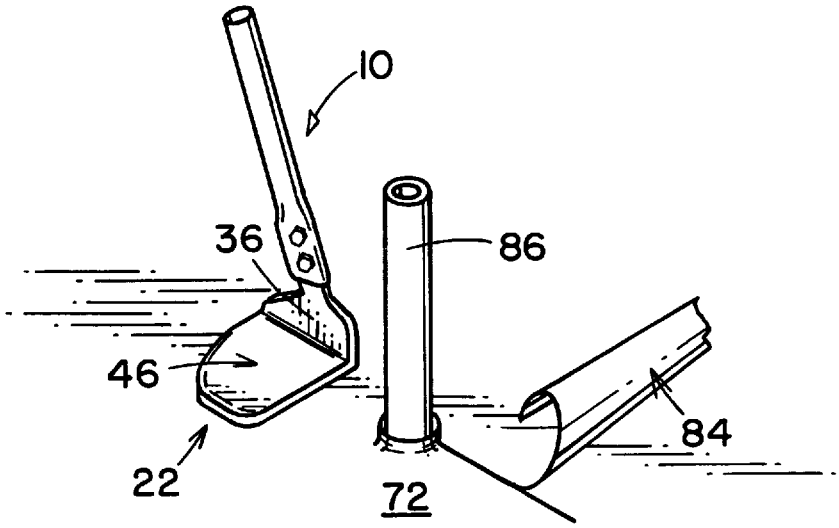
FIG. 9 is a perspective view of the tool of the present invention illustrating its operation around a vent-pipe passing through a roof structure.

FIG. 9 illustrates a special use of the tool 10. The flat bottom 60 of the tool 10 permits easier maneuvering around roof penetrations of the material 72, such as represented by the vent pipe 82. This is due to the fact that a roofer does not have to bend over with the torch flame in his face. Instead, the roofer may use the tapered edges 54, 56 to flip the sheet of roofing material back at 84 to heat the bottom thereof. Once this is heated and replaced, the bottom portion 60 of the device 10 is then capable of smoothing the surface of the roofing material 72 all around any penetration such as caused by the pipe 86.

The broad flat bottom surface 60 of the head member 22 allows a roofer to press down on the hot seams of the edges 70 so that the flow of tar will seal the edges without the roofer having to bend down. In preferred form, the angle between the plane of the bottom 60 and the axis 38 of the handle 12 is preferably between 30° and 60°, with the optimum angle being approximately 45°. This provides the proper angle of attack of the head member 22 onto the surface of the material 72 while the roofer is holding the handle 12 in proper position as described above. With this proper angle, the smooth bottom 60 of the foot portion 46 will not tear into the hot surface of the roofing sheet 72 when pressing down correctly, provided the angle is in fact proper. Moreover, the flat bottom surface 60 of the head member 22 along with the abutment 50 enables a roofer to press hot sheets of roofing material 72 up and onto coved fire wall 78 without bending over or touching the hot material 72 with his hands.

As can be seen from the above, the roofing tool of the present invention allows a roofer to perform the job of applying rolled, preimpregnated roofing material faster and better without the stress of bending over all day. Moreover, the tool of the present invention maintains the roofer at a safe distance from the heat and flame of the torch when standing upright as opposed to leaning over or on his knees using a short trowel tool. In this manner, a roofer is safer and more capable of observing his work to keep the rolled roofing material running in a straight line. When a roofer is bending over using a short handled garden, plaster or other makeshift tool such as used in the prior art, he is not able to see particularly well where he is going as the roofing material is unrolled. When this situation occurs, rolls of material can become crooked, requiring that the sheet be cut and then restarted. This problem is obviated with the use of the present invention. Moreover, the present invention enhances safety by spacing the roofer from the heat and flame of the torch. It enable the roofer to perform all functions necessary to applying rolled roofing, including unrolling of the roofing material, squeezing the tar past the edges, smoothing the heated material along its entire width as it is unrolled, and maneuvering the roofing material even up against coved cant strips along firewall brick. All these functions can be performed by the roofer while the roofer remains is a standing position, thereby removing the roofer from the heat source as well as reducing stress and strain to the roofers' back. Thus, health and safety of roofers are enhanced by utilizing the device of the present invention.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A roofing tool comprising:

an elongated handle having top and bottom end portions;

a head member including a flange portion secured to said bottom end portion and having a base edge and first and second side surfaces, and a foot portion extending outwardly from the base edge of said flange portion away from said flange first side surface, said foot portion having top and bottom surfaces, a front edge, a side edge distal from said flange first side surface, and a rear edge;

said rear and side edges of said foot portion being tapered and said front side edge of said foot portion being at least blunted; and said flange portion being aligned with said handle so that the plane defined by the bottom surface of said foot portion is at approximately a 30°–60° angle relative to an axis of said elongated handle.

2. The tool as claimed in claim 1, wherein said angle is approximately 45°.

3. The tool as claimed in claim 1, wherein said head member further includes a bight portion between the first side surface of said flange portion and the top surface of said foot portion.

4. The tool as claimed in claim 3, wherein the second side surface of said flange portion is at approximately right angles to the bottom surface of said foot portion to form a square corner surface.

5. The tool as claimed in claim 1, wherein said front edge of said foot portion is tapered.

6. The tool as claimed in claim 1, wherein said head member further includes a shank connecting said flange portion to said elongated handle, and wherein the bottom end portion of said handle includes a ferrule receiving one end of said shank.

7. The tool as claimed in claim 6, wherein said shank and said head member are one integral unit.

8. The tool as claimed in claim 6, wherein the bottom end portion of said handle further includes means to permit removable attachment of said shank to said ferrule.

9. The tool as claimed in claim 1, wherein said handle further includes an elongated grip member disposed along a midportion thereof.

10. The tool as claimed in claim 9, wherein said handle is approximately 6 feet long.

11. The tool as claimed in claim 9, wherein a balance point of said device is at approximately a lower end of said grip member.

12. A roofing tool particularly adapted for use with rolled roofing material, said tool comprising:

a elongated handle having top and bottom end portions;

a head member having a connection shank axially aligned with said handle, a flange with first and second side surfaces terminating in a base edge and defining a plane substantially aligned with an axis of said shank, and a foot extending outwardly from said flange base edge and first side surface, said foot having a top surface, a substantially planar bottom surface, a first side edge secured along said flange base edge, and front, rear, and second side edges tapered downwardly away from said foot top surface; and said foot being aligned relative to said shank and flange such that the plane of said foot bottom surface is at an approximately 30°–60° angle to the axis of said shank and handle.

13. The tool as claimed in claim 12, wherein the plane of said foot bottom surface is at an approximately 45° angle to the axis of said shank and handle.

14. The tool as claimed in claim 12, wherein said foot bottom surface and flange second side surface are approximately perpendicular to each other to form a square cornered abutment.

15. The tool as claimed in claim 12, wherein said shank is removably attached to the bottom end portion of said handle, said handle including a ferrule to receive said shank and means to selectively secure said shank thereto.

16. An elongated roofing tool adapted to permit application of rolled roofing material from a standing position, said tool comprising:

an elongated handle having top and bottom end portions; and a head member having a flange connected to said handle end portion and including first and second side surfaces terminating in a base edge, said flange defining a first plane substantially aligned with an axis of said handle, and a foot having a top surface and a substantially flat bottom surface defining a second plane substantially normal to said first plane, said foot having a first side edge abutting said flange base edge at approximately right angles, and remaining end edges being tapered downwardly away from said top surface.

17. The tool as claimed in claim 16, wherein said remaining foot end edges include a front edge, a rear edge and a second side edge distal to said flange base edge, said taper being sized and shaped to permit said remaining foot end edges and upper foot surface to readily slide beneath roofing material.

18. The tool as claimed in claim 17, wherein said foot top surface is substantially flat, and wherein said head member further includes a shank removably interconnecting said flange with said handle bottom end portion.

19. The tool as claimed in claim 16, wherein said second plane is approximately 30°–60° relative to the axis of said handle.

20. The tool as claimed in claim 19, wherein the angle between said second plane and the axis of said handle is approximately 45°.

* * * * *